US010245828B2

(12) United States Patent
Kawahata et al.

(10) Patent No.: US 10,245,828 B2
(45) Date of Patent: Apr. 2, 2019

(54) DISCHARGE WAVEFORM GENERATING DEVICE, METHOD OF GENERATING DISCHARGE WAVEFORM, AND NON-TRANSITORY RECORDING MEDIUM STORING PROGRAM

(71) Applicants: Koji Kawahata, Osaka (JP); Takashi Michiyoshi, Osaka (JP)

(72) Inventors: Koji Kawahata, Osaka (JP); Takashi Michiyoshi, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/662,621

(22) Filed: Jul. 28, 2017

(65) Prior Publication Data

US 2018/0037026 A1 Feb. 8, 2018

(30) Foreign Application Priority Data

Aug. 2, 2016 (JP) ..... 2016-152061

(51) Int. Cl.
*B41J 2/045* (2006.01)
*B41J 2/115* (2006.01)
*B41J 2/21* (2006.01)

(52) U.S. Cl.
CPC ..... *B41J 2/04573* (2013.01); *B41J 2/04541* (2013.01); *B41J 2/04581* (2013.01); *B41J 2/04588* (2013.01); *B41J 2/115* (2013.01); *B41J 2/2135* (2013.01); *B41J 2/2146* (2013.01)

(58) Field of Classification Search
CPC .... B41J 2/04573; B41J 2/04541; B41J 2/115; B41J 29/393; B41J 2029/3935
See application file for complete search history.

(56) References Cited

U.S. PATENT DOCUMENTS

2011/0012948 A1* 1/2011 Kurashina ..... B41J 2/04541 347/10
2014/0092155 A1* 4/2014 Suzuki ..... B41J 2/04541 347/14

FOREIGN PATENT DOCUMENTS

JP 2010-179476 8/2010
JP 2011-020329 2/2011

* cited by examiner

*Primary Examiner* — Geoffrey S Mruk
*Assistant Examiner* — Scott A Richmond
(74) *Attorney, Agent, or Firm* — Oblon, McClelland, Maier & Neustadt, L.L.P.

(57) ABSTRACT

A discharge waveform generating device includes a timing reference generation circuit, a timing adjustment circuit, a waveform pattern generation circuit, and a timing correction circuit. The timing reference generation circuit generates a discharge timing for generating, from image data, a discharge waveform of ink to print the image data, based on a line synchronization signal for synchronizing discharge operations of discharge nozzles to discharge ink. The timing adjustment circuit sets an adjustment value of the discharge timing. The waveform pattern generation circuit generates the waveform from the image data, based on outputs of the timing reference generation circuit and the timing adjustment circuit. The timing correction circuit causes the waveform pattern generation circuit to start generation of the waveform in a condition in which the waveform pattern generation circuit has not finished the generation of the waveform when the timing reference generation circuit receives the line synchronization signal.

12 Claims, 11 Drawing Sheets

DISCHARGE WAVEFORM GENERATING DEVICE, METHOD OF GENERATING DISCHARGE WAVEFORM, AND NON-TRANSITORY RECORDING MEDIUM STORING PROGRAM

CROSS-REFERENCE TO RELATED APPLICATION

This patent application is based on and claims priority pursuant to 35 U.S.C. § 119(a) to Japanese Patent Application No 2016-152061, filed on Aug. 2, 2016, in the Japan Patent Office, the entire disclosure of which is hereby incorporated by reference herein.

BACKGROUND

Technical Field

Aspects of the present disclosure relate to a discharge waveform generating device, a method of generating a discharge waveform, and a non-transitory recording medium storing a program to, when the program is executed on one or more processors, cause the one or more processors to perform the method of generating the discharge waveform.

Related Art

An inkjet printer applies voltages to piezo elements (piezoelectric elements) to control the amount of ink discharged from nozzles to be, for example, large droplet, middle droplet, or small droplet to form an image. The ink discharge is generally performed per line of a matrix into which an image is divided. In such a case, variations in characteristics of piezoelectric elements, characteristics of a discharge waveform generating device to generate voltage waveforms (drive waveforms) to be applied to the piezoelectric elements, and characteristics of ink to be discharged might cause variations in the discharge speed of ink. Such variations in the discharge speed of ink might hamper accurate landing of ink on intended positions of an image. Hence, timing correction may be performed by adjusting the timing of generation of discharge waveforms of ink for each printing line so that ink droplets land on the intended positions.

SUMMARY

In an aspect of the present disclosure, there is provided a discharge waveform generating device that includes a timing reference generation circuit, a timing adjustment circuit, a waveform pattern generation circuit, and a timing correction circuit. The timing reference generation circuit generates a discharge timing as a timing reference for generating, from image data, a discharge waveform of ink to print the image data, based on a line synchronization signal as a reference signal for synchronizing discharge operations of a plurality of discharge nozzles to discharge ink. The timing adjustment circuit sets an adjustment value of the discharge timing, based on the discharge timing generated by the timing reference generation circuit. The waveform pattern generation circuit generates the discharge waveform from the image data, based on outputs of the timing reference generation circuit and the timing adjustment circuit. The timing correction circuit causes the waveform pattern generation circuit to start generation of the discharge waveform in a condition in which the waveform pattern generation circuit has not finished the generation of the discharge waveform when the timing reference generation circuit receives the line synchronization signal.

In another aspect of the present disclosure, there is provided a discharge waveform generating device that includes timing reference generation means, timing adjustment means, waveform pattern generation means, and timing correction means. The timing reference generation means generates a discharge timing as a timing reference for generating, from image data, a discharge waveform of ink to print the image data, based on a line synchronization signal as a reference signal for synchronizing discharge operations of a plurality of discharge nozzles to discharge ink. The timing adjustment means sets an adjustment value of the discharge timing, based on the discharge timing generated by the timing reference generation means. The waveform pattern generation means generates the discharge waveform from the image data, based on outputs of the timing reference generation means and the timing adjustment means. The timing correction means causes the waveform pattern generation means to start generation of the discharge waveform in a condition in which the waveform pattern generation means has not finished the generation of the discharge waveform when the timing reference generation means receives the line synchronization signal.

In still another aspect of the present disclosure, there is provided a method of generating a discharge waveform. The method includes generating a discharge timing as a timing reference for generating, from image data, a discharge waveform of ink to print the image data, based on a line synchronization signal as a reference signal for synchronizing discharge operations of a plurality of discharge nozzles to discharge ink; adjusting a start timing of generation of the discharge waveform, based on the discharge timing generated by the generating; generating the discharge waveform from the image data, based on the start timing adjusted by the adjusting; and starting the generating of the discharge waveform in a condition in which the generating of the discharge waveform has not been finished when receiving the line synchronization signal.

In still yet another aspect of the present disclosure, there is provided a non-transitory recording medium that stores a program to, when the program is executed on one or more processors, cause the one or more processors to perform a method of generating a discharge waveform. The method includes generating a discharge timing as a timing reference for generating, from image data, a discharge waveform of ink to print the image data, based on a line synchronization signal as a reference signal for synchronizing discharge operations of a plurality of discharge nozzles to discharge ink; adjusting a start timing of generation of the discharge waveform, based on the discharge timing generated by the generating; generating the discharge waveform from the image data, based on the start timing adjusted by the adjusting; and starting the generating of the discharge waveform in a condition in which the generating of the discharge waveform has not been finished when receiving the line synchronization signal.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1A:
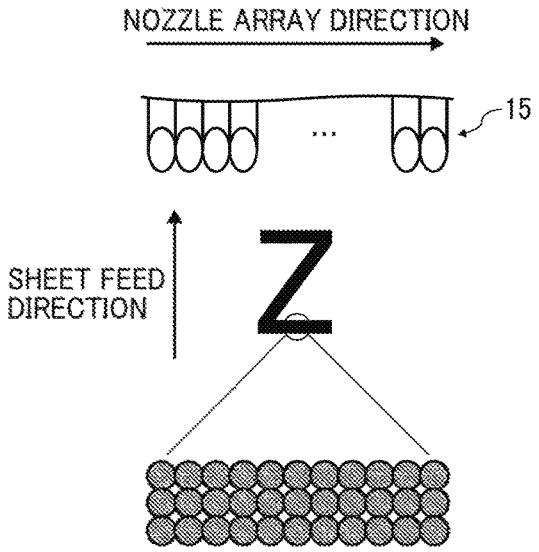
FIG. 1A is an illustration of a comparative example of a discharge waveform generating device in a state in which no distortion occurs in a printed image.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Below, a description is given of embodiments of a discharge waveform generating device and a program with reference to attached drawings.

In a discharge waveform generating device, one cycle of a line synchronization signal to specify each printing line may be evenly divided into channels by, for example, a delay lock loop (DLL). For each of the evenly-divided channels, the generation of a discharge waveform of ink is started at a divided timing designated based on the line synchronization signal. When the conveyance speed of a print sheet of paper is changed, it is necessary to change the cycle of the line synchronization signal to normally perform the printing operation. In other words, when the conveyance speed of the print sheet is increased, the cycle of the line synchronization signal is shortened. By contrast, when the conveyance speed of the print sheet is decreased, the cycle of the line synchronization signal is lengthened. Even if the conveyance speed of the print sheet is constant, the cycle of the line synchronization signal varies due to fluctuations. Therefore, for example, when the cycle of the line synchronization signal varies to be shorter, an adjustment range of discharge timing would cover a plurality of printing lines and the designated divided timings would not appear on the same printing line. In such a case, printing to be performed on the printing line is not performed, thus causing ink dropout.

According to at least one embodiment of the present disclosure, discharge timing of ink can reliably be controlled with reference to time intervals into which the cycle of a line synchronization signal is evenly divided, thus preventing image distortion due to ink dropout.

First, a comparative example of a discharge waveform generating device is described below.

Figure 1B:
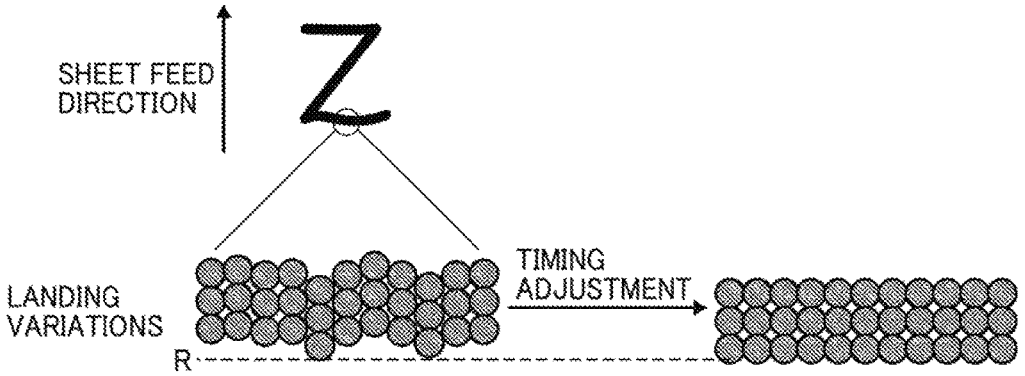
FIG. 1B is an illustration of the comparative example of the discharge waveform generating device of FIG. 1A in a state in which a printed image is distorted by temporal variations of landing of ink on a print medium and a state in which an image is printed with the image distortion adjusted.
Figure 2A:
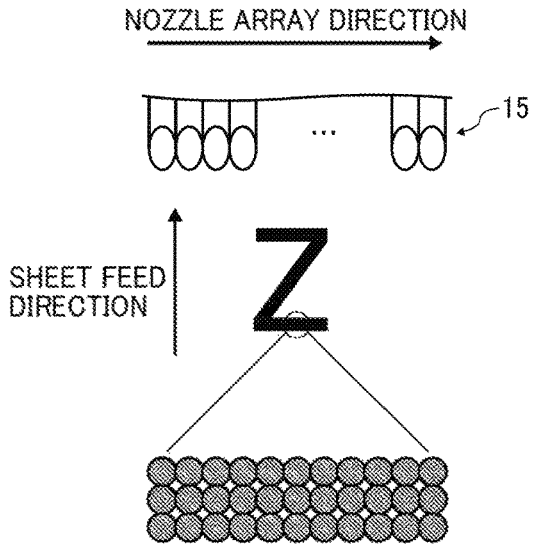
FIG. 2A is an illustration of another comparative example of a discharge waveform generating device in a state in which no distortion occurs in a printed image.
Figure 2B:
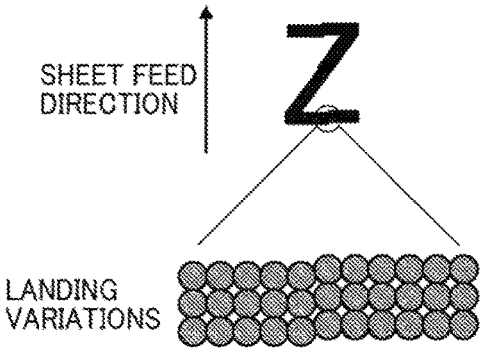
FIG. 2B is an illustration of the comparative example of the discharge waveform generating device of FIG. 2A in a state in which a printed image is distorted by temporal variations of landing of ink on a print medium.
Figure 2C:
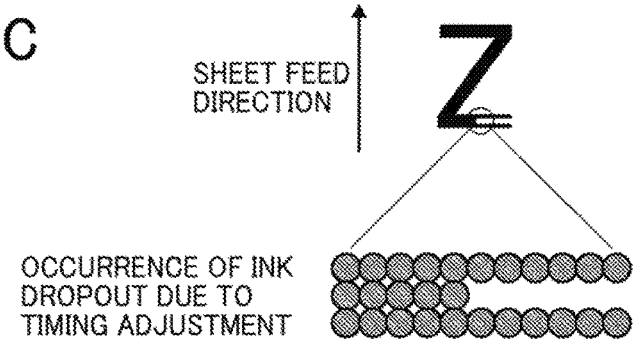
FIG. 2C is an illustration of the comparative example of the discharge waveform generating device of FIG. 2A in a state in which ink dropout occurs when printing is performed while regulating image distortion by adjusting discharge timing.

FIGS. 1A and 1B are illustrations of a problem of a comparative example of a discharge waveform generating device, that is, an example in which a printed image is distorted by temporal variations of landing of ink on a print medium. FIGS. 2A through 2C are illustrations of another problem of the comparative example of the discharge waveform generating device, that is, an example in which ink dropout occurs when printing is performed while regulating image distortion by adjusting discharge timing.

As illustrated in FIG. 1A, ink droplets discharged from a plurality of discharge nozzles 15 disposed along a printing line land on target positions on a print medium. Thus, a desired discharge operation, that is, printing is performed. When a straight line parallel to a row of the discharge nozzles 15 (hereinafter, nozzle row) is printed, a row of dots (hereinafter, dot row) aligned on a straight line can be printed. However, variations in characteristics of a piezoelectric element to drive the discharge nozzles 15, a driver integrated circuit (IC) to drive the piezoelectric element, and ink to be discharged might cause variations in the discharge speed of ink. Such variations in the discharge speed of ink might cause misalignment of the landing positions of discharged ink droplets.

If misalignment occurs in the landing positions of discharged ink droplets, as illustrated in FIG. 1B, a dot row would not be aligned on a straight line when a straight line parallel to the nozzle row is printed. As a result, an outline of a printed graphic may be blurred. Accordingly, for example, when a small character is printed, the character may be illegible. Hence, generally, for example, a test pattern is printed and the landing positions of ink droplets from discharge nozzles are checked (calibrated). The checked result is fed back to the discharge timing from the discharge nozzles to perform timing adjustment. In such a case, as illustrated in FIG. 1B, it is simple to align ink droplets on a latest landing line R by delaying a discharge timing to discharge ink from earlier driven ones of the discharge nozzles 15.

Alternatively, as illustrated in FIG. 2C, when discharge timing is adjusted, a discharge waveform to discharge ink may be lost, thus causing ink dropout in which no ink is discharged from a discharge nozzle(s). For example, assume a case in which the above-described adjustment of discharge timing is performed when misalignment of landing positions as illustrated in FIG. 2B occurs, unlike a normal print state illustrated in FIG. 2A. If fluctuations (jitter) occur in the cycle of a line synchronization signal characterizing each printing line, a new synchronization signal might occur before discharge timing corresponding to the amount of delay (delay value) of preset discharge timing. In such a case, since an originally-intended discharge waveform is not generated, the discharge waveform would be lost. Accordingly, as illustrated in FIG. 2C, ink dropout would occur, that is, some ink droplets are not discharged.

Figure 3:
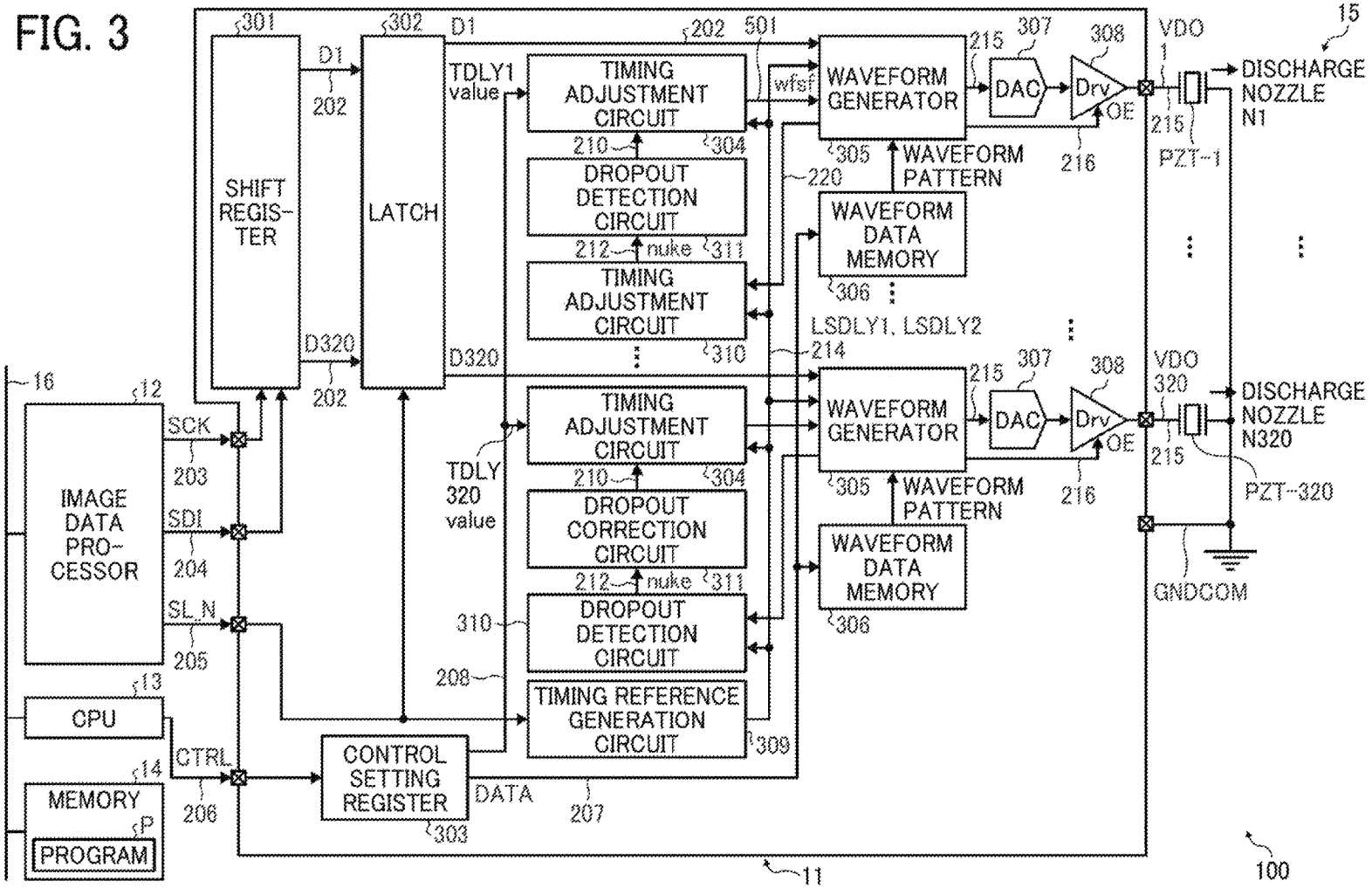
FIG. 3 is a block diagram of a hardware configuration of a discharge waveform generating device according to an embodiment of the present disclosure.

Next, a hardware configuration of a discharge waveform generating device 100 according to an embodiment of the present disclosure is described with reference to FIG. 3. FIG. 3 is a block diagram of a hardware configuration of the discharge waveform generating device 100 according to an embodiment of the present disclosure. As illustrated in FIG. 3, the discharge waveform generating device 100 includes a discharge waveform generation processing unit 11, an image data processor 12, a central processing unit (CPU) 13, a memory 14, and the discharge nozzles 15. Note that the discharge waveform generating device 100 forms part of a liquid discharge apparatus, for example, an inkjet printer.

The discharge waveform generation processing unit 11 generates discharge timing of ink from the discharge nozzles 15, for each discharge nozzle 15. Ink discharge is controlled by applying the generated discharge waveforms to the discharge nozzles 15. The configuration of the discharge waveform generation processing unit 11 is further described later.

The image data processor 12 holds an image to be formed by the liquid discharge apparatus, such as an inkjet printer. The image data processor 12 analyzes brightness, tone value, and color information of the image held, and designates a discharge waveform for each dot of ink to the discharge waveform generation processing unit 11. The image data processor 12 transmits waveform selection signal transfer clocks SCK (203) and waveform pattern selection signals SDI (204), and a line synchronization signal SL_N (205) to the discharge waveform generation processing unit 11.

The line synchronization signal SL_N (205) is a synchronization signal representing a discharge cycle of the discharge nozzles 15.

The waveform selection signal transfer clocks SCK (203) are signals in which clocks corresponding to the number of the discharge nozzles 15 are generated during one cycle of the line synchronization signal SL_N (205). Note that, in the discharge waveform generating device 100 according to the present embodiment, the number of the discharge nozzles 15 is 320 and the waveform selection signal transfer clocks SCK (203) are signals in which 320 clocks are generated. The waveform selection signal transfer clocks SCK (203) designate discharge waveforms to be used for the respective ones (from channel 1 to channel 320) of the 320 discharge nozzles 15 (of N1 to N320), in connection with the waveform pattern selection signals SDI (204).

The waveform pattern selection signal SDI (204) is a signal synchronized with the waveform selection signal transfer clocks SCK (203), to designate, for each channel, which of the discharge waveforms stored in a waveform data memory 306 is to be used. For example, when eight types of discharge waveforms are stored in the waveform data memory 306, the waveform pattern selection signal SDI (204) is a 3-bit signal to specify one of the eight types of discharge waveforms. The greater the number of types of discharge waveforms, the greater the number of bits of the waveform pattern selection signal SDI (204).

The discharge waveform generating device 100 has a configuration of a general computer system. The CPU 13 reads and executes programs P stored in the memory 14 to control processing performed by the discharge waveform generating device 100. The CPU 13 sends a control signal CTRL (206) to the discharge waveform generation processing unit 11 to set a discharge waveform corresponding to each of the discharge nozzles 15 (N1 to N320) to the waveform data memory 306 of the discharge waveform generation processing unit 11. The CPU 13 causes the discharge nozzles 15 to print a test pattern as calibration operation and sets discharge timing corresponding to each discharge nozzle to a timing adjustment circuit 304 via the control signal CTRL (206). The CPU 13 also executes the programs P to control the operation of the image data processor 12.

The memory 14 stores, for example, the programs P, image data, various types of data used by the discharge waveform generating device 100. The memory 14 includes a random access memory (RAM) being a main storage device and a read only memory (ROM) being a secondary storage device. The programs P are loaded on the RAM in executable format and executed by the CPU 13. The image data and various types of data used by the discharge waveform generating device 100 are stored in the ROM and referred by the CPU 13 and the image data processor 12 as needed.

The CPU 13, the memory 14, and the image data processor 12 are connected to each other via an internal bus 16.

The discharge nozzles 15 are a plurality of discharge nozzles of N1 to N320 with piezoelectric elements. In FIG. 3, an example is illustrated in which the discharge waveform generating device 100 includes 320 discharge nozzles of N1 to N320 with piezoelectric elements PZT-1 to PZT-320. The piezoelectric elements PZT-1 to PZT-320 are applied with drive voltages VDO1 (215) to VDO320 (215), respectively. Then, pressure is applied to channels below the piezoelectric elements PZT-1 to PZT-320, thus causing each of the discharge nozzles 15 (N1 to N320) to output ink at an amount corresponding to the drive voltage VDOn (215) (n=1 to 320). In other words, the drive voltage VDOn (215) (n=1 to 320) uniquely corresponds to the discharge waveform of ink to be discharged from each discharge nozzle 15.

Next, a description is given of a hardware configuration of the discharge waveform generation processing unit 11 according to an embodiment of the present disclosure. The discharge waveform generation processing unit 11 includes a shift register 301, a latch 302, a control setting register 303, a timing reference generation circuit 309, a waveform generator 305, the waveform data memory 306, a digital-to-analog (DA) converter 307, a driver 308, the timing adjustment circuit 304, a dropout detection circuit 310, and a dropout correction circuit 311.

Note that, in the discharge waveform generation processing unit 11, the number of each of the waveform generator 305, the waveform data memory 306, the DA converter 307, the driver 308, the timing adjustment circuit 304, the dropout detection circuit 310, and the dropout correction circuit 311 is the same as the number of the discharge nozzles 15, for example, 320 in the example illustrated in FIG. 3.

According to the waveform selection signal transfer clocks SCK (203), the shift register 301 converts the waveform pattern selection signals SDI (204) being serial signals to waveform selection signals D1 to D320 (202) that are parallels signals corresponding to the discharge nozzles 15 (N1 to N320), respectively. The waveform selection signals D1 to D320 (202) may be different data between the channels and are updated in synchronization with the line synchronization signal SL_N (205).

The latch 302 holds the waveform selection signals (D1 to D320) (202), which have been converted to the parallels signal by the shift register 301, in synchronous with the line synchronization signal SL_N (205).

The control setting register 303 receives discharge waveforms from the CPU 13 via the control signal CTRL (206) and writes the received discharge waveforms as waveform pattern signals DATA (207) onto the waveform data memories 306 corresponding to the respective channels. After calibration, the control setting register 303 receives TDLY values 208, which are adjustment values of discharge timing of the respective channels, from the CPU 13 via the control signal CTRL (206), and holds the TDLY values 208. The TDLY values 208 are set for the respective channels and includes values of TDLY1 to TDLY320. Hereinafter, TDLYn value 208 represents the TDLY value 208 held by the channel n.

The timing reference generation circuit 309, which is an example of a timing reference generator, generates timing reference signals LSDLY1 and LSDLY2 (214) used to adjust the discharge timing. Each of the timing reference signals LSDLY1 and LSDLY2 (214) includes a count value counted up at 32 equal time intervals into which one cycle of the line synchronization signal SL_N (205) is divided. Hereinafter, CNT1 represents the count value of the timing reference signal LSDLY1 (214) and CNT2 represents the count value of the timing reference signal LSDLY2 (214). The 32 equal time intervals, into which one cycle of the line synchronization signal SL_N (205) is divided, represent a temporal resolution of discharge timing adjustment. Note that the 32 equal time intervals are one example and any other suitable value may be used.

Each of the timing reference signals LSDLY1 and LSDLY2 (214) holds a count value counted over two cycles of the line synchronization signal SL_N (205). Note that the phases of the timing reference signal LSDLY1 and the timing reference signal LSDLY2 are shifted from each other by one cycle of the line synchronization signal SL_N (205). The timing reference signals LSDLY1 and LSDLY2 (214) are further described later.

The waveform generator 305, which is an example of a waveform pattern generator, generates the drive voltages VDO (215) (discharge waveforms) of the piezoelectric elements PZT-1 to PZT-320 according to the waveform selection signals D1 to D320 (202).

The waveform data memory 306 stores a plurality of sets of waveform patterns to generate the drive voltages VDO (215). The waveform data memory 306 may be a plurality of memories separately provided for the respective channels as illustrated in FIG. 3. Alternatively, the waveform data memory 306 may be a single memory shared among all the channels.

The DA converter 307 converts the drive voltage VDO (215) generated by the waveform generator 305 to an analog waveform.

The driver 308 raises the drive voltage VDO (215) of the analog waveform generated by the DA converter 307 to a voltage at which the piezoelectric elements PZT-1 to PZT-320 can be driven. The driver 308 receives a signal OE (216) from the waveform generator 305 and raises the drive voltage VDO (215).

The timing adjustment circuit 304, which is an example of a timing adjuster, generates a waveform generation start signal wfsf (501) to instruct the start of generation of the drive voltage VDO (215) to the waveform generator 305 when the count value CNT1 of each channel is equal to the TDLYn value or the count value CNT2 is equal to the TDLYn value. Accordingly, the timing adjustment circuit 304 adjusts the generation start timing of the discharge waveform of ink.

The dropout detection circuit 310 generates a dropout signal nuke (212) indicating occurrence of ink dropout according to the timing reference signals LSDLY1 and LSDLY2 (214). The dropout signal nuke (212) is reset when a waveform generation end flag 220 (see FIG. 4) indicating the end of generation of the drive voltage VDO (215) for one dot is received from the waveform generator 305, which is further described later.

The dropout correction circuit 311, which is an example of a timing corrector, receives the dropout signal nuke (212) and instructs the start of generation of the waveform generation start signal wfsf (501) to the timing adjustment circuit 304 when the timing reference signals LSDLY1 and LSDLY2 (214) are predetermined count values CNT1 and CNT2, in other words, CNT1 is equal to the TDLYn value or CNT2 is equal to the TDLYn value, which is further described later. Note that the dropout correction circuit 311 sends, to the timing adjustment circuit 304, a trigger signal 210 to generate the waveform generation start signal wfsf (501).

Below, a description is given of operation of components of the discharge waveform generating device 100.

Figure 4:
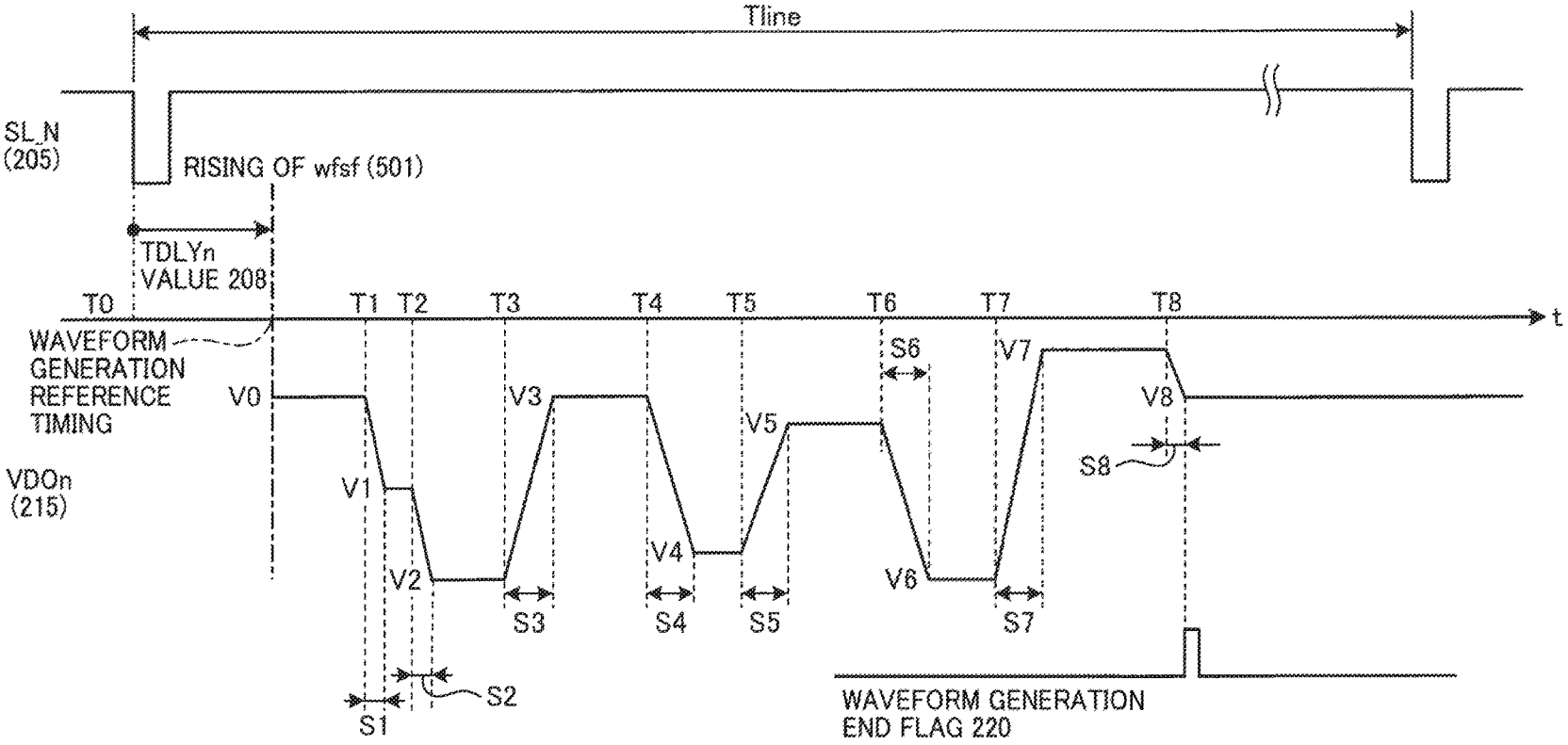
FIG. 4 is a timing chart of an example of a drive voltage (discharge waveform) to drive a piezoelectric element, generated by the discharge waveform generating device of FIG. 3.

Drive voltage waveform is described below. FIG. 4 is a timing chart of an example in which the waveform generator 305 illustrated in FIG. 3 generates the drive voltage VDOn (215) (n=1 to 320) to drive the discharge nozzle 15 on the basis of the line synchronization signal SL_N (205). The line synchronization signal SL_N (205) represents a discharge cycle of the discharge nozzles 15 (N1 to N320) arranged in one row, that is, a cycle Tline of printing one dot. The line synchronization signal SL_N (205) is low active and uses a falling point (e.g., time t=T0 in FIG. 4) as a time reference.

The waveform generator 305 sets voltage values V0 to V8, times T1 to T8, and shift times S1 to S8 illustrated in FIG. 4 to generate the drive voltage VDOn (215). A given number of sets of the voltage values V0 to V8, the times T1 to T8, and the shift times S1 to S8 are prepared as waveform patterns and stored in the waveform data memories 306 (of FIG. 3) separately provided for the respective discharge nozzles 15. The image data processor 12 (see FIG. 3) designates the waveform pattern to be output for each line.

The drive voltage VDOn (215) is applied to each of the piezoelectric elements PZT-1 to PZT-320 (see FIG. 3) at later stage. The drive voltage waveform set to the waveform data memory 306 outputs, as the drive voltage VDOn (215), the waveform pattern stored in the waveform data memory 306 by using the rising timing of the waveform generation start signal wfsf (501) as a starting point. The waveform generation start signal wfsf (501) designates a time delayed from a start timing of the line synchronization signal SL_N (205) by the TDLYn value 208 (n=1 to 320) (see FIG. 3), which is an adjustment value of discharge timing (adjustment value of delay time) separately set for each channel.

When the generation of the drive voltage waveform for one dot is completed, the waveform generator 305 further outputs the waveform generation end flag 220 indicating the completion of generation of the drive voltage waveform. The waveform generation end flag 220 output from the waveform generator 305 is input to the dropout detection circuit 310 (see FIG. 3).

Figure 5A:
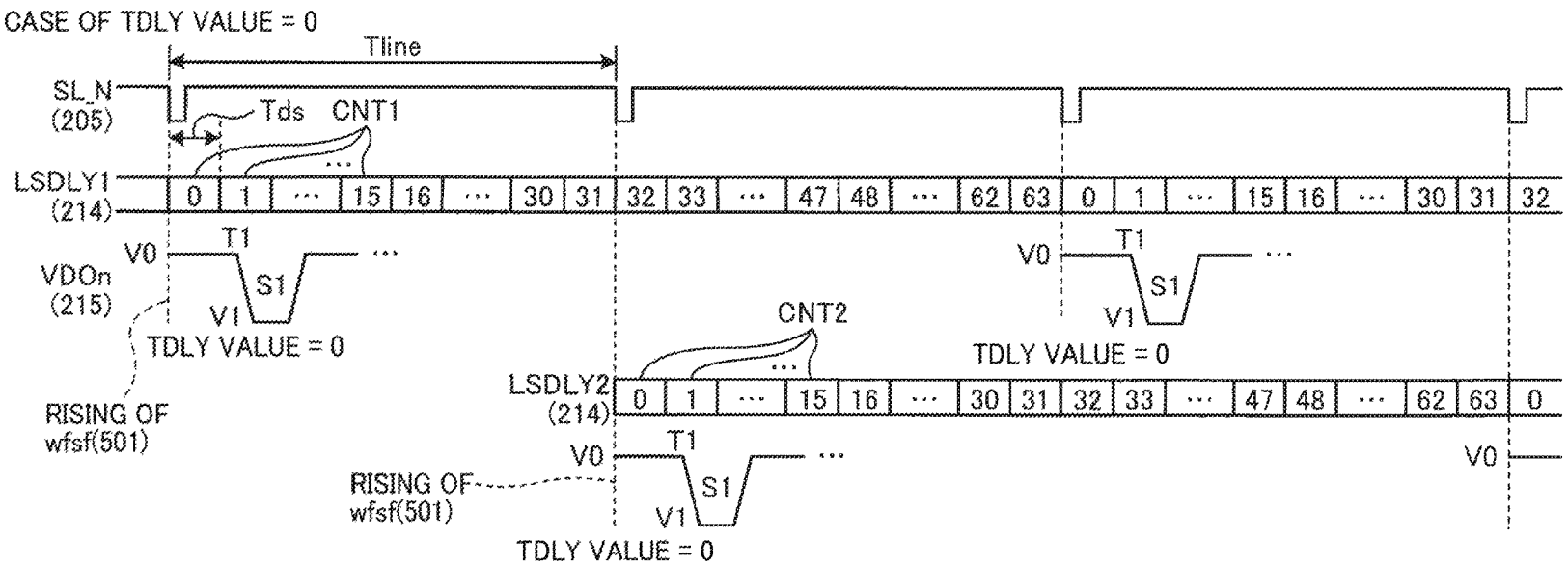
FIG. 5A is a timing chart of an example in which no timing adjustment of the generation of a discharge waveform is performed based on equal time intervals into which a line synchronization signal is divided.
Figure 5B:
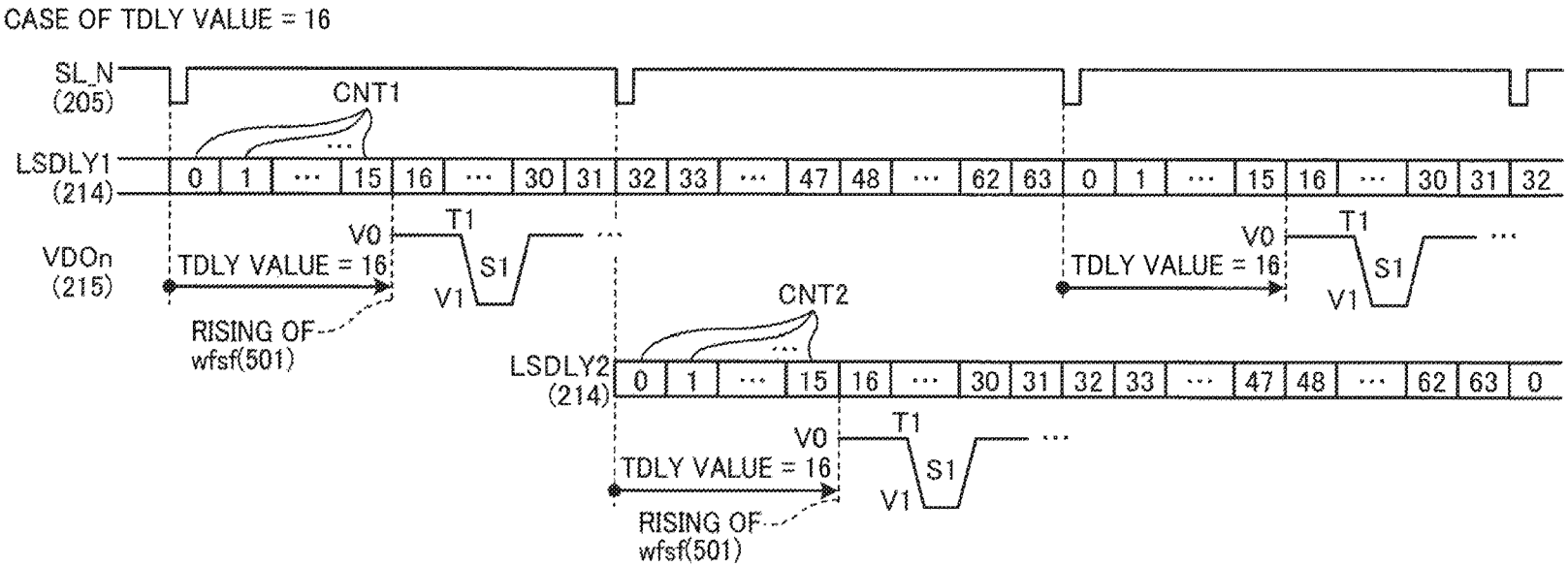
FIG. 5B is a timing chart of an example in which the timing adjustment is performed by delaying a discharge timing by a predetermined delay amount.

A description is given of a method of adjusting discharge timing. FIGS. 5A and 5B are examples of timing charts in which discharge timing is adjusted based on equal time intervals (32 equal time intervals) into which the line synchronization signal SL_N (205) is divided. In the examples, the temporal resolution Tds of the amount of adjustment of discharge timing is one thirty-seconds of the cycle Tline of printing one dot. Note that FIG. 5A is a chart of an example in which the discharge timing is not adjusted (TDLY value=0), in other words, an example in which the drive voltage VDOn (215) is generated in synchronization with the generation of the line synchronization signal SL_N (205). FIG. 5B is a chart of an example in which the drive voltage VDOn (215) is generated with a delay of a delay amount of 16 Tds from the generation of the line synchronization signal SL_N (205) (TDLY value=16).

The timing reference generation circuit 309 (see FIG. 3) counts up each of the timing reference signals LSDLY1 and LSDLY2 (214) at 32 equal time intervals into which one cycle of the line synchronization signal SL_N (205) is divided, and holds the count values of the timing reference signals LSDLY1 and LSDLY2 (214) for two cycles. Note that the phases of the two timing reference signals LSDLY1 and LSDLY2 (214) are shifted by one cycle of the line synchronization signal SL_N (205).

In other words, the count values of the timing reference signal LSDLY1 (214) and the timing reference signal LSDLY2 (214) are set to 0 and 32, respectively, or 32 and 0, respectively, per falling edge of the line synchronization signal SL_N (205). When the count values are set, the timing reference generation circuit 309 starts counting up the timing reference signals LSDLY1 and LSDLY2 (214). When the TDLYn value 208, which is an adjustment value of discharge timing set to each channel, matches the count values CNT1 and CNT2 of the timing reference signals LSDLY1 and LSDLY2 (214), the timing adjustment circuit 304 (see FIG. 3) generates a waveform generation start signal wfsf (501). The waveform generator 305 (see FIG. 3) generates the drive voltage VDOn (215) of one dot in response to the rising timing of the waveform generation start signal wfsf (501) generated by the timing adjustment circuit 304.

Figure 6:
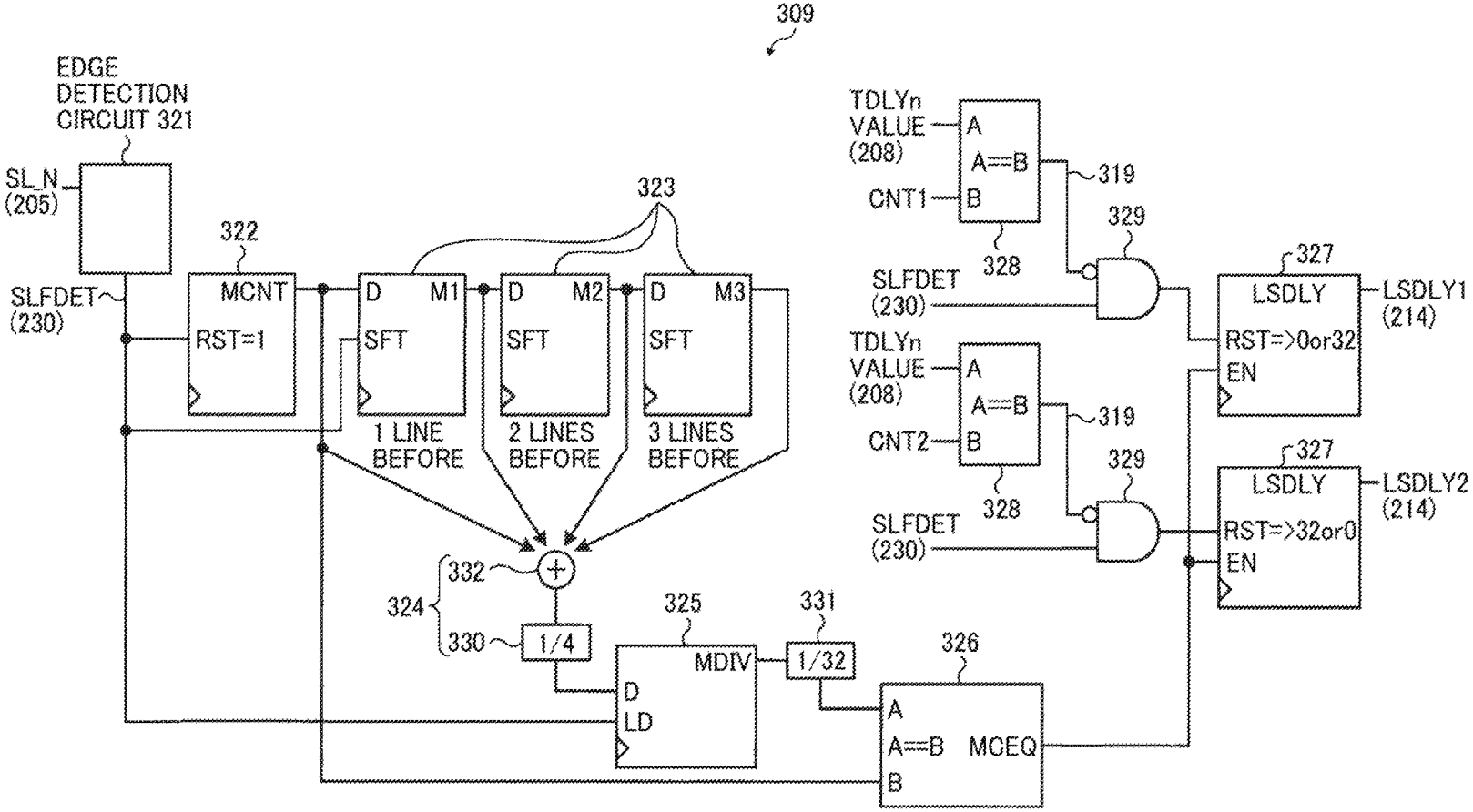
FIG. 6 is a diagram of an example of an internal configuration of a timing reference generation circuit.

Next, an operation in which the timing reference generation circuit 309 generates the timing reference signals LSDLY1 and LSDLY2 (214) is described with reference to FIG. 6. FIG. 6 is an illustration of an example of an internal configuration of the timing reference generation circuit 309.

As illustrated in FIG. 6, the timing reference generation circuit 309 includes an edge detection circuit 321, a cycle measurement counter 322, shift registers 323, a moving average value calculation circuit 324, a moving average value holding register 325, a comparator 326, 32-dividing counters 327, comparators 328, gate elements 329, and a 5-bit shift register 331.

The edge detection circuit 321 detects a falling edge position (see FIG. 4) of the line synchronization signal SL_N (205). The edge detection circuit 321 outputs a detection result of the falling edge position as an edge detection signal SLFDET (230).

The cycle measurement counter 322 measures a cycle Tline of the line synchronization signal SL_N (205) of one line before. The cycle measurement counter 322 outputs a terminal MCNT of the measured cycle Tline.

The shift registers 323 hold the cycles Tline of the line synchronization signal SL_N (205) of the preceding three lines, that is, one line before, two line before, and three line before.

The moving average value calculation circuit 324 includes an adder 332 and a two-bit shift register 330. The moving average value calculation circuit 324 calculates a moving average value of the cycles Tline of the line synchronization signal SL_N (205) of a total of four lines including the current line and the preceding three lines. Specifically, the moving average value calculation circuit 324 calculates a sum of the cycles Tline of the line synchronization signal SL_N (205) of the four lines with the adder 332 and shifts (quarters) the addition result rightward by two bits with the two-bit shift register 330 to obtain the moving average value of the cycles Tline.

The moving average value holding register 325 holds the moving average value calculated with the moving average value calculation circuit 324. The moving average value holding register 325 outputs the held moving average value from a terminal MDIV.

The comparator 326 compares a value obtained by shifting the moving average value rightward by five bits (that is, dividing the moving average value by 32) with the 5-bit shift register 331 with a value of low-order 5 bits of the count result of the cycle measurement counter 322. When the values match, in other words, whenever a time obtained by dividing the moving average value of the cycles Tline of the line synchronization signal SL_N (205) by 32 passes, the comparator 326 outputs a reference time elapse signal MCEQ.

With reference to the falling edge position of the line synchronization signal SL_N (205), each time the 32-dividing counters 327 receive input of the reference time elapse signal MCEQ, the 32-dividing counter 327 counts up the count value CNT1 of the timing reference signal LSDLY1 (214) and the count value CNT2 of the timing reference signal LSDLY2 (214). The 32-dividing counters 327 separately output the timing reference signals LSDLY1 and LSDLY2 (214).

The 32-dividing counters 327 to generate the timing reference signals LSDLY1 and LSDLY2 (214) are alternately set to 0 or 32 at the edge falling position of the line synchronization signal SL_N (205), to count the line synchronization signal SL_N (205) for two cycles, that is, count 0 through 63 as illustrated in FIG. 5. In other words, the two 32-dividing counters 327 are disposed. At one time, when one of the 32-dividing counters 327 is set to 0 according to the edge detection signal SLFDET (230) of the line synchronization signal SL_N (205), the other of the 32-dividing counters 327 is set to 32, thus synchronizing the 32-dividing counters 327.

One of the comparators 328 compares the TDLYn value 208 with the count value CNT1 of the timing reference signal LSDLY1. When the TDLYn value 208 is equal to the count value CNT1, the one of the comparators 328 outputs a trigger signal 319 to one of the gate elements 329. The other of the comparators 328 compares the TDLYn value 208 with the count value CNT2 of the timing reference signal LSDLY2 (214). When the TDLYn value 208 is equal to the count value CNT2, the other of the comparators 328 outputs a trigger signal 319 to the other of the gate elements 329.

The gate element 329 calculates a logical conjunction of the trigger signal 319 output from the comparator 328 and the edge detection signal SLFDET (230) detected with the edge detection circuit 321. For example, when the comparator 328 detects that the TDLYn value 208 is equal to 31 and the LSDLY2 (214) is equal to 31, the gate element 329 inhibits the 32-dividing counter 327 from counting up the count value CNT2 of the timing reference signal LSDLY2 (214) to 32. The 32-dividing counter 327 continues counting. As described above, by inhibiting drop of the timing reference signals LSDLY1 and LSDLY2 (214) when the timing reference signals LSDLY1 and LSDLY2 (214) match the TDLYn value 208, non-generation of the waveform generation start signal wfsf (501) can be prevented, thus preventing ink dropout.

In the example illustrated in FIG. 6, the number of cycles of the line synchronization signal SL_N (205) used to calculate the moving average value is four. However, the number of cycles used to calculate the moving average value is not limited to four. Alternatively, instead of the moving average value, only the cycle Tline of the line synchronization signal SL_N (205) of one line before may be used. In some embodiments, instead of the moving average value calculation circuit 324, for example, a digital phase-locked loop (PLL) circuit may be used to calculate the moving average value.

Figure 7:
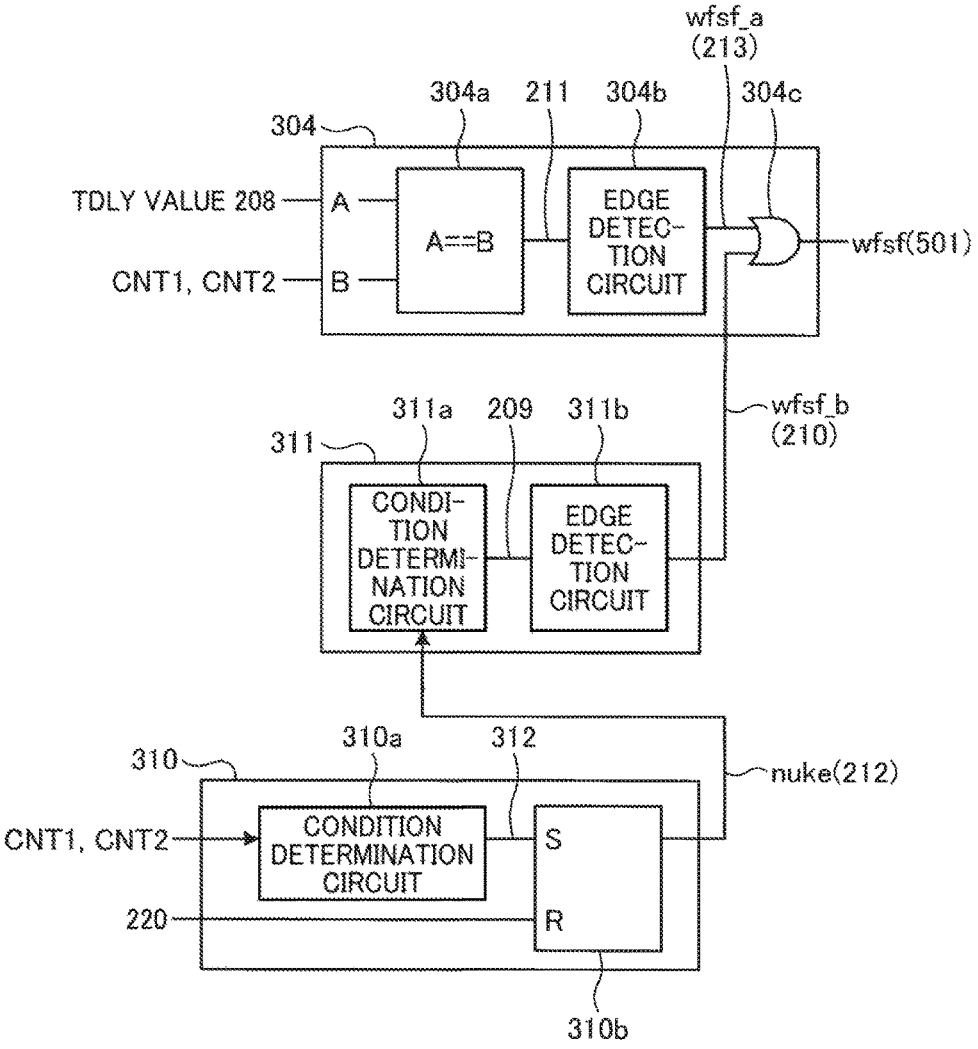
FIG. 7 is a diagram of an example of internal configurations of a timing adjustment circuit, a dropout detection circuit, and a dropout correction circuit.

Next, operations of the timing adjustment circuit 304, the dropout detection circuit 310, and the dropout correction circuit 311 are described with reference to FIG. 7. FIG. 7 is a diagram of an example of internal configurations of the timing adjustment circuit 304, the dropout detection circuit 310, and the dropout correction circuit 311. Note that the functions of the circuits are as described above.

Below, a description is given of operation of the timing adjustment circuit 304. The timing adjustment circuit 304, as illustrated in FIG. 7, includes a comparator 304*a*, an edge detection circuit 304*b*, and a gate element 304*c*. The timing adjustment circuit 304 outputs the waveform generation start signal wfsf (501) when the dropout correction circuit 311 outputs a trigger signal wfsf_b (210) or when the TDLYn value (208) is equal to the count value CNT1 of the timing reference signal LSDLY1 (214) or the count value CNT2 of the timing reference signal LSDLY2 (214).

The comparator 304*a* compares the TDLYn value 208, which is a delay setting value, with each of the count values CNT1 and CNT2 of the timing reference signals LSDLY1 and LSDLY2 (214). The comparator 304*a* outputs a trigger signal 211 to the edge detection circuit 304*b* when the TDLYn value 208 is equal to the count value CNT1 or CNT2.

The edge detection circuit 304*b* detects a change point of the signal level, that is, the edge position from the trigger signal 211 output from the comparator 304*a*, to generate a trigger signal wfsf_a (213).

The gate element 304*c* calculates a logical addition of the trigger signal wfsf_a (213), which is an output of the edge detection circuit 304*b*, and the trigger signal wfsf_b (210), which is an output of the dropout correction circuit 311, to output the waveform generation start signal wfsf (501).

Next, a description is given of a dropout detection circuit. The cycle of the line synchronization signal SL_N (205) varies with the conveyance speed of a print medium (e.g., a print sheet of paper). Accordingly, the timing reference signals LSDLY1 and LSDLY2 (214) are synchronized with the line synchronization signal SL_N (205) and the count values CNT1 and CNT2 are reset to 0 or 32. If the current cycle Tline of the line synchronization signal SL_N (205) is shorter than the cycle Tline of the line synchronization signal SL_N (205) measured in the past, a specific count value CNT1 of the timing reference signal LSDLY1 (214) or a specific count value CNT2 of the timing reference signal LSDLY2 (214) may be skipped. For example, this applies to a case in which the degree of shortness of the cycle Tline is greater than one thirty-seconds of the cycle Tline of the line synchronization signal SL_N (205) in the example of FIG. 4, that is, the temporal resolution Tds (see FIG. 5). In such a case, if the TDLYn value 208, which is a delay setting value of one discharge nozzle 15, is set to match the skipped timing, a timing at which the TDLYn value is equal to CNT1 or CNT2 would be lost in the cycle of the line synchronization signal SL_N (205). At this time, since the waveform generator 305 does not start generation of the drive voltage VDO (215), ink would not be discharged, thus causing a missing dot.

Below, a description is given of an operation of the dropout detection circuit 310 to detect occurrence of such missing dot. The dropout detection circuit 310, as illustrated in FIG. 7, includes a condition determination circuit 310*a* and a reset-set (RS) flip flop 310*b*.

When the count value CNT1 of the timing reference signal LSDLY1 (214) or the count value CNT2 of the timing reference signal LSDLY2 (214) changes, the condition determination circuit 310*a* determines whether the count value CNT1 or CNT2 has changed from 30 to 32 (skipped 31). Note that, at this time, the other of the count values CNT1 and CNT2 changes from 62 to 0 (skipped 63). In other words, any of the two count values CNT1 and CNT2 changes by a change amount other than plus 1. The condition determination circuit 310*a* outputs the trigger signal 312 when both of the count value CNT1 and the count value CNT2 have changed by a change amount other than plus 1.

The RS flip flop 310*b* outputs the dropout signal nuke (212). When the trigger signal 312 is detected, the dropout signal nuke (212) is set to rise. When the rising edge of the waveform generation end flag 220 is detected, the dropout signal nuke (212) is reset to fall. The dropout signal nuke (212) output from the RS flip flop 310*b* is input to the dropout correction circuit 311.

Next, a description is given of an operation of the dropout correction circuit 311. The dropout correction circuit 311, as illustrated in FIG. 7, includes a condition determination circuit 311*a* and an edge detection circuit 311*b*.

The condition determination circuit 311*a* determines whether the dropout signal nuke (212) is at high level and the count value CNT1 of the timing reference signal LSDLY1 (214) or the count value CNT2 of the timing reference signal LSDLY2 (214) is 32. The condition determination circuit 311*a* outputs a trigger signal 209 when the dropout signal nuke (212) is at high level and the count value CNT1 or CNT2 is 32.

The edge detection circuit 311*b* detects an edge of the trigger signal 209 output from the condition determination circuit 311*a*. The edge detection circuit 311*b* outputs the detection result as the trigger signal wfsf_b (210). The trigger signal wfsf_b (210) output from the edge detection circuit 311*b* is input to the gate element 304*c* of the timing adjustment circuit 304.

Below, a detecting operation of ink dropout of the discharge waveform generating device 100 is described with reference to a timing chart of FIG. 8.

Figure 8:
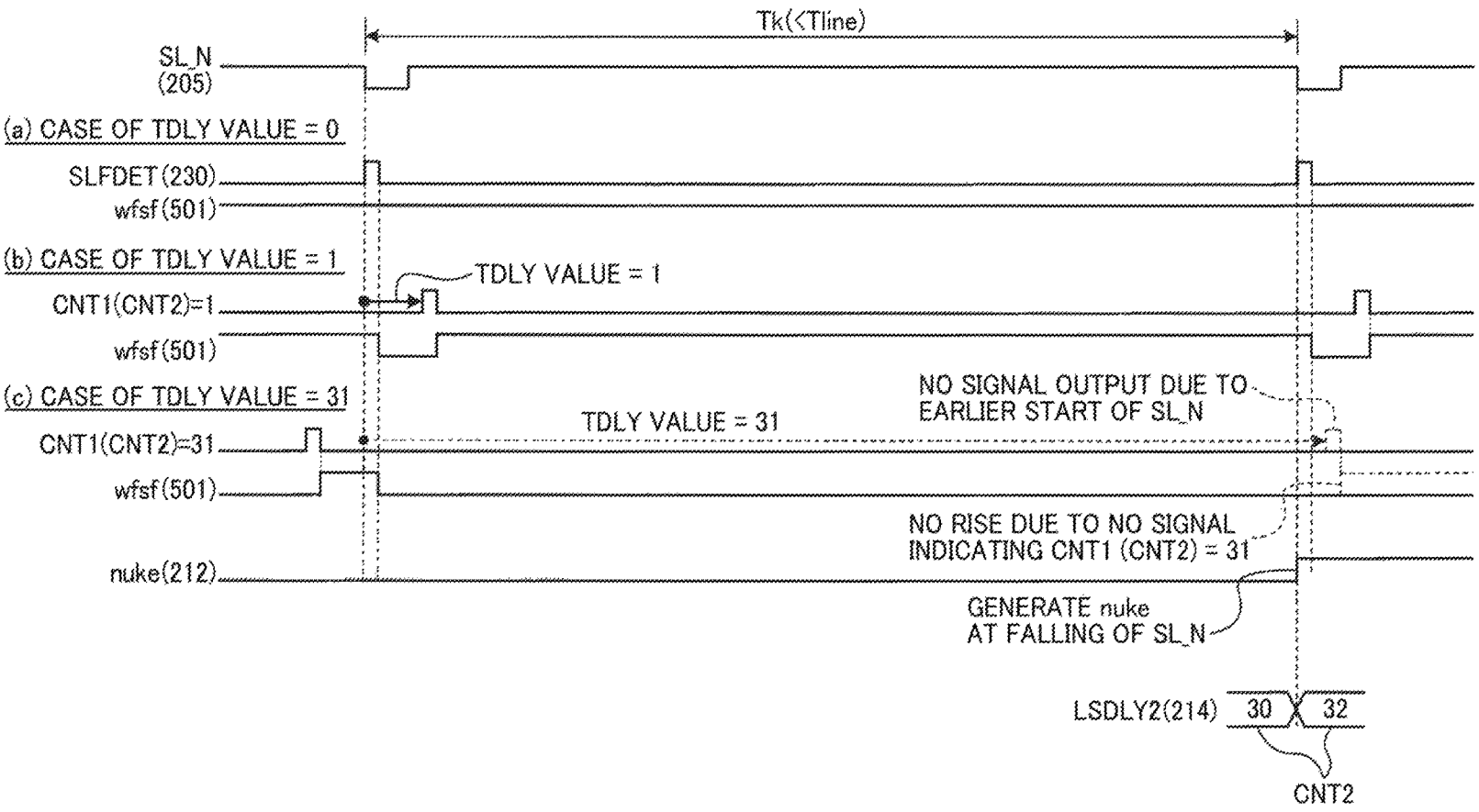
FIG. 8 is a timing chart of a detecting operation of ink dropout performed by the discharge waveform generating device of FIG. 3: part (a) is a chart of an example in which discharge timing is not adjusted, part (b) is a chart of an example in which discharge timing is adjusted with a TDLY value set to 1, and part (c) is a chart of an example in which discharge timing is adjusted with the TDLY value set to 31.

FIG. 8 is a timing chart of a detecting operation of ink dropout performed by the dropout detection circuit 310, the dropout correction circuit 311, and the timing adjustment circuit 304. Note that, in the timing chart of FIG. 8, a cycle Tk of the line synchronization signal SL_N (205) is a cycle having changed to be shorter than the predetermined cycle Tline of printing one dot.

Part (a) of FIG. 8 is a timing chart of a case in which discharge timing is not adjusted, that is, the TDLY value 208 being an adjustment value of discharge timing is 0. The edge detection signal SLFDET (230) illustrated in FIG. 8A is, as described above, a signal detected as a falling edge of the line synchronization signal SL_N (205) with the edge detection circuit 321 (see FIG. 6). The rising position of the edge detection signal SLFDET (230) is a reference position at which the counting of the timing reference signals LSDLY1 and LSDLY2 (214) (see FIGS. 5A and 5B) starts.

The timing adjustment circuit 304 (see FIG. 7) sets the waveform generation start signal wfsf (501) to be at high level when one of the count values CNT1 and CNT2 of the timing reference signals LSDLY1 and LSDLY2 (214) matches 0, which is set as the TDLY value 208. Since the waveform generation start signal wfsf (501) is at high level as an initial value, as illustrated in part (a) of FIG. 8, the waveform generation start signal wfsf (501) is constantly kept at high level. When one of the count values CNT1 and CNT2 of the timing reference signals LSDLY1 and LSDLY2 (214) matches 0, which is set as the TDLY value 208, the waveform generator 305 (see FIG. 3) determines that the waveform generation start signal wfsf (501) is at high level, and starts generation of the drive voltage VDO (215). Accordingly, in the case of part (a) of FIG. 8, no ink dropout occurs.

Part (b) of FIG. 8 is a timing chart of a case in which discharge timing is adjusted with the TDLY value 208 set to 1. In the case of part (b) of FIG. 8, the timing adjustment circuit 304 (see FIG. 7) detects that one of the count values CNT1 and CNT2 of the timing reference signals LSDLY1 and LSDLY2 (214) matches 1, which is set as the TDLY value 208. The timing adjustment circuit 304 sets the waveform generation start signal wfsf (501), which has changed to low level at falling of the edge detection signal SLFDET (230), to be at high level again. When one of the count values CNT1 and CNT2 of the timing reference signals LSDLY1 and LSDLY2 (214) matches 1, which is set as the TDLY value 208, the waveform generator 305 determines that the waveform generation start signal wfsf (501) is at high level, and starts generation of the drive voltage VDO (215). Accordingly, in the case of part (b) of FIG. 8, no ink dropout occurs.

Part (c) of FIG. 8 is a timing chart of a case in which discharge timing is adjusted with the TDLY value 208 set to 31. In the case of part (c) of FIG. 8, the timing adjustment circuit 304 detects that one of the count values CNT1 and CNT2 of the timing reference signals LSDLY1 and LSDLY2 (214) matches 31, which is set as the TDLY value 208. However, in the case of part (c) of FIG. 8, the cycle Tk of the line synchronization signal SL_N (205) is shorter than the original cycle Tline, a new line synchronization signal SL_N (205) occurs before the count value CNT1 or CNT2 reaches 31. In part (c) of FIG. 8, an example is illustrated in which the count value CNT2 of the timing reference signal LSDLY2 (214) changes from 30 to 32.

In such a case, in a condition in which the count value CNT1 or CNT2 has skipped 31, the dropout detection circuit 310 (see FIG. 7) sets the dropout signal nuke (212) to be at high level on detection of the generation of the new line synchronization signal SL_N (205). The timing adjustment circuit 304 sets the waveform generation start signal wfsf (501) to be at high level, according to the dropout signal nuke (212) and one of the count values CNT1 and CNT2 of the timing reference signals LSDLY1 and LSDLY2 (214). The waveform generator 305 receives the waveform generation start signal wfsf (501) and generates the drive voltage VDO (215). Accordingly, in the case of part (c) of FIG. 8, no ink dropout also occurs. Note that the dropout detection circuit 310 sets the dropout signal nuke (212) to be at low level when the generation of the drive voltage VDO (215) is completed.

Next, adjustment processing of discharge timing performed when ink dropout occurs is described with reference to FIG. 9.

Figure 9:
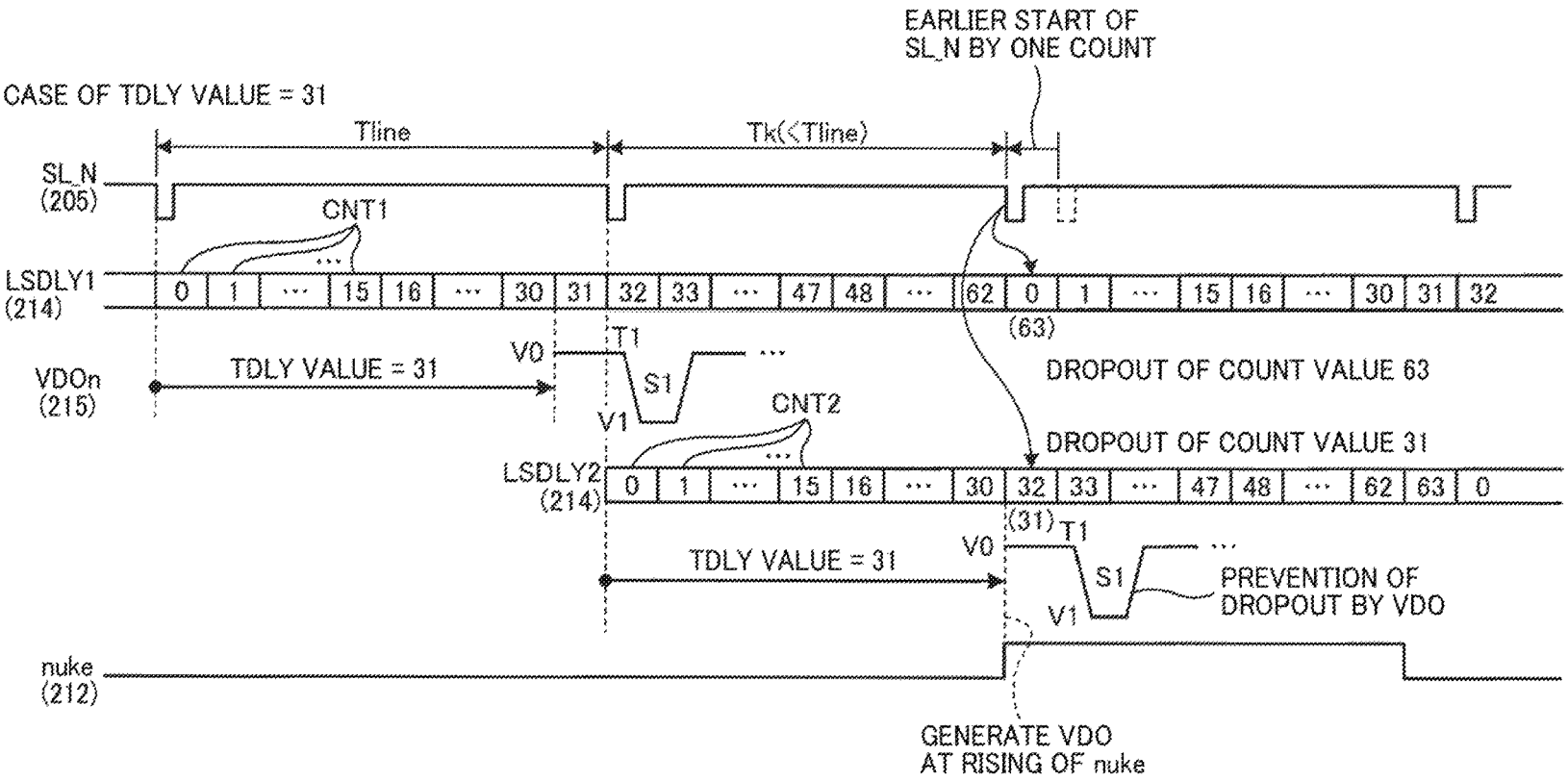
FIG. 9 is a timing chart of adjustment processing of discharge timing performed when ink dropout occurs.

FIG. 9 is a timing chart of a case in which discharge timing is adjusted with the TDLY value 208 set to 31 when the cycle Tk of the line synchronization signal SL_N (205) is shorter than the predetermined cycle Tline of printing one dot.

In FIG. 9, the cycle Tk of the line synchronization signal SL_N (205) is earlier than the predetermined cycle Tline by one count of the 32 divided cycles of the line synchronization signal SL_N (205). At this time, 63 as the count value CNT1 of the timing reference signal LSDLY1 (214) and 31 as the count value CNT2 of the timing reference signal LSDLY2 (214) are skipped, and the count values CNT1 and CNT2 are reset to 0 and 32, respectively.

At this time, the dropout detection circuit 310 detects that the count value CNT1 or CNT2 has discontinuously changed, and generates the dropout signal nuke (212) indicating the occurrence of ink dropout.

The timing adjustment circuit 304 (see FIG. 3) detects that the dropout signal nuke (212) is at high level, and causes the waveform generator 305 (see FIG. 3) to start generation of the drive voltage VDO (215) when the count values CNT1 and CNT2 of the timing reference signals LSDLY1 and LSDLY2 (214) are reset to 0 and 32, respectively.

Accordingly, even in a case in which conventionally ink dropout occurs, the generation of the drive voltage VDO (215) is started according to the dropout signal nuke (212), thus preventing occurrence of ink dropout. Note that the timing reference signals LSDLY1 and LSDLY2 (214) for starting the generation of the drive voltage VDO (215) shift from the timing reference signals LSDLY1 and LSDLY2 (214) for other channels, but can synchronize with the timing reference signals LSDLY1 and LSDLY2 (214) for other channels based on a subsequently-generated line synchronization signal SL_N (205).

Next, a flow of adjustment processing of discharge timing performed by the discharge waveform generating device 100 is described with reference to FIG. 10.

Figure 10:
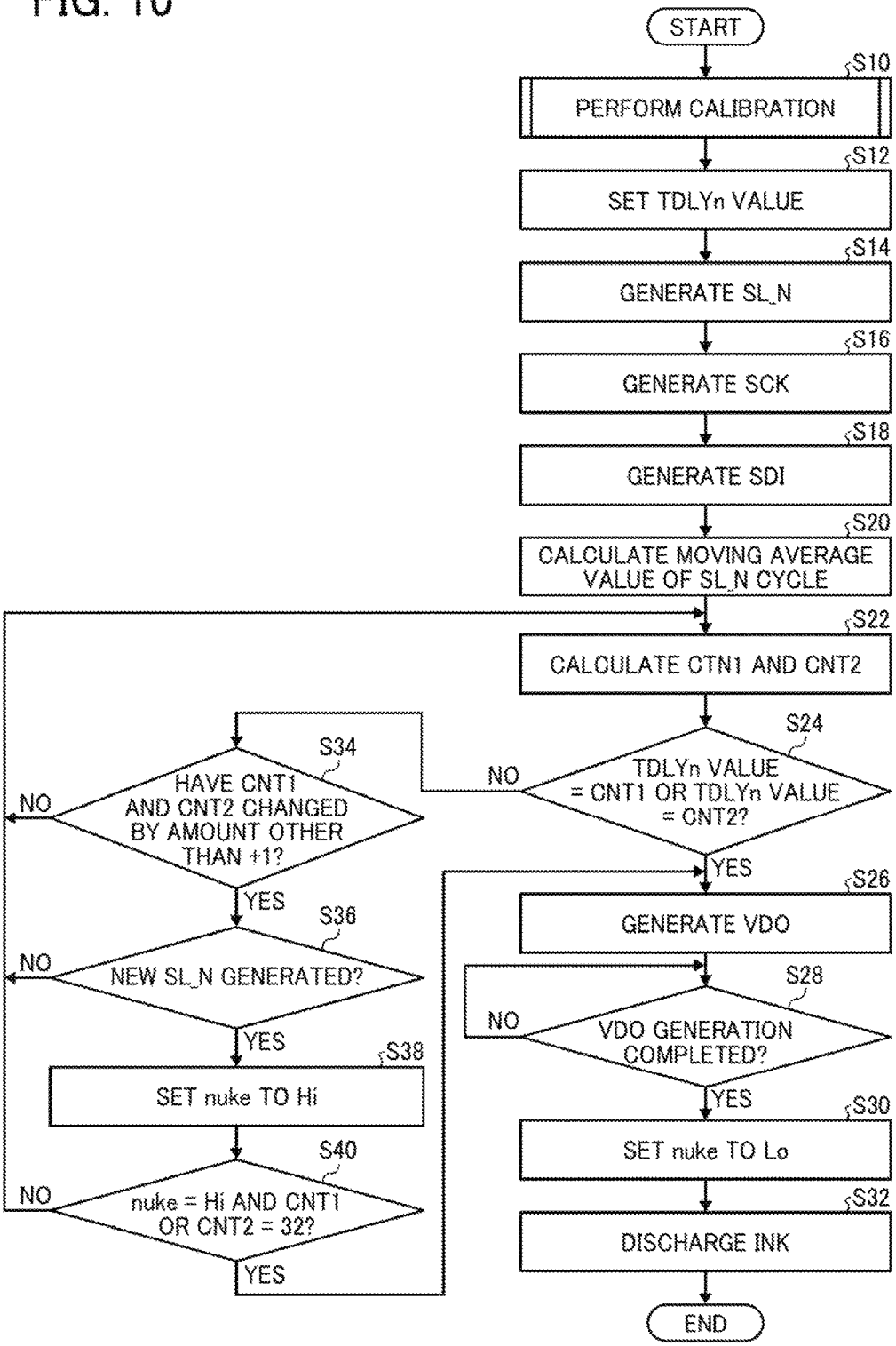
FIG. 10 is a flowchart of adjustment processing of discharge timing performed by the discharge waveform generating device of FIG. 3.

FIG. 10 is a flowchart of adjustment processing of discharge timing performed by the discharge waveform generating device 100. Note that the flowchart of FIG. 10 relates to a case in which discharge timing is corrected based on 32 equal time intervals into which one cycle of the line synchronization signal SL_N (205) is evenly divided. The flowchart of FIG. 10 relates to processing on a specific channel. Indeed, the discharge waveform generating device 100 performs the processing illustrated in the flowchart of FIG. 10 on all channels (e.g., n=1 to 320).

First, the discharge waveform generating device 100 performs calibration to check the landing position of ink for each of the discharge nozzles 15 (step S10). Detailed descriptions of calibration are omitted here.

The control setting register 303 sets the TDLYn value 208 (n=1 to 320) according to the calibration result (step S12).

The image data processor 12 generates the line synchronization signal SL_N (205) (step S14). Note that the cycle Tline of the line synchronization signal SL_N (205) is determined according to the conveyance speed of a print medium (e.g., a print sheet of paper).

The image data processor 12 generates the waveform selection signal transfer clocks SCK (203) (step S16).

The image data processor 12 generates the waveform pattern selection signal SDI (204) (step S18).

The moving average value calculation circuit 324 calculates the moving average value of the cycle Tline of the line synchronization signal SL_N (205) (step S20).

The timing reference generation circuit 309 calculates the count value CNT1 of the timing reference signal LSDLY1 (214) and the count value CNT2 of the timing reference signal LSDLY2 (214) (step S22).

The timing adjustment circuit 304 determines whether the TDLYn value 208 is equal to the count value CNT1 or CNT2 (step S24). When the TDLYn value 208 is equal to the count value CNT1 or CNT2 (YES at step S24), the process goes to step S26. Otherwise (NO at step S24), the process goes to step S34.

When the TDLYn value 208 is equal to the count value CNT1 or CNT2 (YES at S24), the waveform generator 305 generates the drive voltage VDO (215) (step S26).

The waveform generator 305 determines whether the generation of the drive voltage VDO (215) has been completed (step S28). When the generation of the drive voltage VDO (215) has been completed (YES at step S28), the process goes to step S30. Otherwise (NO at step S28), the processing of step S28 is repeated.

When the waveform generator 305 determines that the generation of the drive voltage VDO (215) has been completed (YES at step S28), the dropout detection circuit 310 sets the dropout signal nuke (212) to be at low level (Lo) (step S30).

The discharge waveform generating device 100 discharges ink from the nozzle 15 (step S32). Then, the processing of FIG. 10 ends.

When the TDLYn value 208 is not equal to both the count value CNT1 and the count value CNT2 (NO at step S24), the dropout detection circuit 310 determines whether both the count values CNT1 and CNT2 have changed by a change amount other than plus 1 (step S34). When both the count values CNT1 and CNT2 have changed by a change amount other than plus 1 (YES at step S34), the process goes to step S36. Otherwise (NO at step S34), the process returns to step S22.

The image data processor 12 determines whether a new line synchronization signal SL_N (205) has been generated (step S36). When the new line synchronization signal SL_N (205) has been generated (YES at step S36), the process goes to step S38. Otherwise (NO at step S36), the process returns to step S22.

When the image data processor 12 determines that the new line synchronization signal SL_N (205) has been generated (YES at step S36), the dropout detection circuit 310 sets the dropout signal nuke (212) to be at high level (Hi) (step S38).

The dropout correction circuit 311 determines whether the dropout signal nuke (212) is at high level and the count value CNT1 or CNT2 is 32 (step S40). When the dropout signal nuke (212) is at high level and the count value CNT1 or CNT2 is 32 (YES at step S40), the process goes to step S26. Otherwise (NO at step S40), the process returns to step S22.

As described above, with the discharge waveform generating device 100 according to the present embodiment, when the timing reference generation circuit 309 as the timing reference generator acquires the line synchronization signal SL_N (205), the dropout correction circuit 311 as the timing corrector causes the waveform generator 305 to start generation of the drive voltage VDO1 (215) as a discharge waveform, in a condition in which the waveform generator 305 as the waveform pattern generator has not completed the generation of the drive voltage VDO1 (215). Accordingly, even when a new line synchronization signal SL_N (205) occurs before a timing corresponding to a delay time of delaying the generation of the drive voltage VDO1 (215) (as discharge waveform), the generation of the drive voltage VDO1 (215) can be started, thus preventing image distortion due to ink dropout.

With the discharge waveform generating device 100 according to the present embodiment, the timing reference generation circuit 309 as the timing reference generator calculates the moving average value of the cycles Tline of the line synchronization signal SL_N (205) of a plurality of lines, and generates discharge timing with reference to equal time intervals into which the moving average value is divided. Accordingly, since variations are reduced in measurement results of the cycles Tline of the line synchronization signal SL_N (205), it can be reliably detected that the cycle Tline has changed due to a change in conveyance speed of a print medium (e.g., a print sheet of paper) and fluctuations in the cycle Tline of the line synchronization signal SL_N (205). Thus, since the discharge timing of the discharge nozzles 15 can be reliably adjusted, the occurrence of ink dropout can reliably be prevented.

With the discharge waveform generating device 100 according to the present embodiment, the timing adjustment circuit 304 as the timing adjuster sets the TDLY value 208, which is an adjustment value of discharge timing of ink calculated in advance, for each of the discharge nozzles 15. Accordingly, even when the discharge waveform generating device 100 includes the plurality of discharge nozzles 15, discharge timing of each of the discharge nozzles 15 can reliably be adjusted.

With the discharge waveform generating device 100 according to the present embodiment, the dropout correction circuit 311 as the timing corrector causes the waveform generator 305 as the waveform pattern generator to start generation of the drive voltage VDO1 (215) before a discharge timing corresponding to the TDLY value 208 being the adjustment value of discharge timing, in a condition in which a new line synchronization signal SL_N (205) has been generated. Accordingly, the occurrence of ink dropout can reliably be prevented with a simple calculation.

In the above descriptions, some embodiments are described. However, the configurations of the components and the content of processing are not limited to the above-described embodiments.

For example, the programs P may be provided in an installable or executable file format recorded in a computer-readable recording medium, such as a compact disc read only memory (CD-ROM), a flexible disk (FD), a compact disc recordable (CD-R), or a digital versatile disc (DVD), instead of being provided with the programs P stored in advance in the memory 14. Alternatively, the programs P may be stored in a computer connected to a network, such as the Internet, and provided in a downloadable format via the network. In some embodiments, the programs P may be provided or distributed through a network, such as the Internet.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A discharge waveform generating device comprising:

a timing reference generation circuit to generate a discharge timing as a timing reference for generating, from image data, a discharge waveform of ink to print the image data, based on a line synchronization signal as a reference signal for synchronizing discharge operations of a plurality of discharge nozzles to discharge ink;

a timing adjustment circuit to set an adjustment value of the discharge timing, based on the discharge timing generated by the timing reference generation circuit;

a waveform pattern generation circuit to generate the discharge waveform from the image data, based on outputs of the timing reference generation circuit and the timing adjustment circuit; and a timing correction circuit to cause the waveform pattern generation circuit to start generation of the discharge waveform in a condition in which the waveform pattern generation circuit has not finished generation of a currently generated discharge waveform when the timing reference generation circuit receives the line synchronization signal.

2. The discharge waveform generating device according to claim 1, wherein the timing reference generation circuit calculates a moving average value of cycles of a plurality of line synchronization signals and generates the discharge timing with reference to time intervals into which the moving average value is evenly divided.

3. The discharge waveform generating device according to claim 1, wherein the timing adjustment circuit sets the adjustment value of the discharge timing for each of the plurality of discharge nozzles.

4. The discharge waveform generating device according to claim 1, wherein the timing correction circuit causes the waveform pattern generation circuit to start the generation of the discharge waveform in a condition in which a new line synchronization signal has occurred before an arrival of the discharge timing adjusted with the adjustment value.

5. The discharge waveform generating device according to claim 1, further comprising a memory configured to store waveform data, and the waveform pattern generation circuit uses the waveform data stored in the memory to generate the discharge waveform.

6. The discharge waveform generating device according to claim 1, wherein a timing of the line synchronization signal is controlled according to a speed of a recording medium.

7. A discharge waveform generating device comprising:

timing reference generation means for generating a discharge timing as a timing reference for generating, from image data, a discharge waveform of ink to print the image data, based on a line synchronization signal as a reference signal for synchronizing discharge operations of a plurality of discharge nozzles to discharge ink;

timing adjustment means for setting an adjustment value of the discharge timing, based on the discharge timing generated by the timing reference generation means;

waveform pattern generation means for generating the discharge waveform from the image data, based on outputs of the timing reference generation means and the timing adjustment means; and timing correction means for causing the waveform pattern generation means to start generation of the discharge waveform in a condition in which the waveform pattern generation means has not finished generation of a currently generated discharge waveform when the timing reference generation means receives the line synchronization signal.

8. The discharge waveform generating device according to claim 7, wherein the timing reference generation means calculates a moving average value of cycles of a plurality of line synchronization signals and generates the discharge timing with reference to time intervals into which the moving average value is evenly divided.

9. The discharge waveform generating device according to claim 7, wherein the timing adjustment means sets the adjustment value of the discharge timing for each of the plurality of discharge nozzles.

10. The discharge waveform generating device according to claim 7, wherein the timing correction means causes the waveform pattern generation means to start the generation of the discharge waveform in a condition in which a new line synchronization signal has occurred before an arrival of the discharge timing adjusted with the adjustment value.

11. A method of generating a discharge waveform, the method comprising:

generating a discharge timing as a timing reference for generating, from image data, a discharge waveform of ink to print the image data, based on a line synchronization signal as a reference signal for synchronizing discharge operations of a plurality of discharge nozzles to discharge ink;

adjusting a start timing of generation of the discharge waveform, based on the discharge timing generated by the generating;

generating the discharge waveform from the image data, based on the start timing adjusted by the adjusting; and starting the generating of the discharge waveform in a condition in which generating of a currently generated discharge waveform has not been finished when receiving the line synchronization signal.

12. A non-transitory recording medium storing a program to, when the program is executed on one or more processors, cause the one or more processors to perform a method of generating a discharge waveform, the method comprising:

generating a discharge timing as a timing reference for generating, from image data, a discharge waveform of ink to print the image data, based on a line synchronization signal as a reference signal for synchronizing discharge operations of a plurality of discharge nozzles to discharge ink;

adjusting a start timing of generation of the discharge waveform, based on the discharge timing generated by the generating;

generating the discharge waveform from the image data, based on the start timing adjusted by the adjusting; and starting the generating of the discharge waveform in a condition in which generating of a currently generated discharge waveform has not been finished when receiving the line synchronization signal.

* * * * *